US008939712B2

(12) United States Patent
Cortequisse

(10) Patent No.: US 8,939,712 B2
(45) Date of Patent: Jan. 27, 2015

(54) EXTERNAL SEGMENTED SHELL CAPABLE OF CORRECTING FOR ROTOR MISALIGNMENT IN RELATION TO THE STATOR

(75) Inventor: Jean-Francois Cortequisse, Heers (BE)

(73) Assignee: Techspace Aero S.A. (BE)

( * ) Notice: Subject to any disclaimer, the term of this patent is extended or adjusted under 35 U.S.C. 154(b) by 456 days.

(21) Appl. No.: 13/407,948

(22) Filed: Feb. 29, 2012

(65) Prior Publication Data

US 2012/0224953 A1 Sep. 6, 2012

(30) Foreign Application Priority Data

Mar. 3, 2011 (EP) ..... 11156828

(51) Int. Cl.
*F01D 25/24* (2006.01)
*F01D 11/12* (2006.01)
*F04D 29/52* (2006.01)

(52) U.S. Cl.
CPC ..... *F01D 11/122* (2013.01); *F04D 29/526* (2013.01); *F05D 2260/38* (2013.01); *F05D 2240/11* (2013.01); *F05D 2250/312* (2013.01); *F05D 2300/501* (2013.01)
USPC ..... 415/119; 415/127; 415/139; 415/173.3; 415/173.4; 415/197

(58) Field of Classification Search
USPC ..... 415/119, 126, 127, 128, 135, 136, 138, 415/139, 173.1, 173.3, 173.4, 173.6, 174.2, 415/174.4, 196, 197, 200
See application file for complete search history.

(56) References Cited

U.S. PATENT DOCUMENTS

| | | | | |
|---|---|---|---|---|
| 2,634,090 | A * | 4/1953 | Hardigg | 415/135 |
| 3,966,356 | A * | 6/1976 | Irwin | 415/173.3 |
| 6,113,349 | A | 9/2000 | Bagepalli et al. | |
| 6,340,286 | B1 * | 1/2002 | Aksit et al. | 415/173.3 |
| 6,406,256 | B1 | 6/2002 | Marx | |
| 6,547,522 | B2 * | 4/2003 | Turnquist et al. | 415/173.3 |
| 7,189,057 | B2 * | 3/2007 | Lee et al. | 415/136 |
| 7,753,648 | B2 * | 7/2010 | Evans et al. | 415/191 |
| 2008/0159850 | A1 | 7/2008 | Tholen et al. | |

FOREIGN PATENT DOCUMENTS

| | | | |
|---|---|---|---|
| DE | 10342208 | A1 | 4/2005 |
| DE | 102004010236 | A1 | 9/2005 |
| DE | 102008007321 | A1 | 8/2009 |
| EP | 2112326 | A1 | 10/2009 |
| EP | 1113146 | B1 | 3/2010 |
| FR | 2636373 | A1 | 3/1990 |

* cited by examiner

*Primary Examiner* — Igor Kershteyn
(74) *Attorney, Agent, or Firm* — Polster Lieder

(57) ABSTRACT

The invention relates to a housing for covering the ends of a row of rotor blades of an axial turbomachine compressor, the housing being provided with a sealing device between the blade tips and the housing. It comprises a shell segmented along its circumference, each segment being fixed to the housing by a series of elastomeric elements in a recess in the shape of a channel cut into the inner surface of the housing. In this way, in the event of misalignment of the rotor relative to the stator, the rotor blades coming into contact with sections of the shell will be able to move to compensate for this misalignment while reducing the frictional forces generated by contact between the blades and the shell. In the event of alignment being re-established the segments of the shell will be able to resume their initial position because of the elastic behavior of the elements.

16 Claims, 3 Drawing Sheets

EXTERNAL SEGMENTED SHELL CAPABLE OF CORRECTING FOR ROTOR MISALIGNMENT IN RELATION TO THE STATOR

CROSS-REFERENCE TO RELATED APPLICATIONS

This application claims the benefit, under 35 U.S.C. §119, of European Application No. EP 11156828.3, which was filed on Mar. 3, 2011, the content of which is incorporated here by reference in its entirety.

FIELD

The invention relates to a housing for covering the tips of a row of rotor blades, the housing being provided with a sealing device between the blade tips and the housing. More specifically the invention relates to such a housing for an axial turbomachine compressor. The invention also relates to an axial turbomachine compressor comprising such a housing.

BACKGROUND

The statements in this section merely provide background information related to the present disclosure and may not constitute prior art.

During the lifetime of a turbomachine, one of the irreversible reasons for increasing clearances is misalignment of the rotor axis relative to the stator, with the clearance closing up on one side and increasing on the other.

For turbomachines there are at least two sources of misalignment that are reversible and limited to the duration of the mission: first, that related to maneuvering loads (gyroscopic torques related to variations in the attitude of the turbomachine), and secondly, associated with the ingestion of foreign bodies (such as birds). On the other hand, a slight misalignment which is reversible and reparable can occur during the lifetime of the turbomachine. It is caused by an imbalance associated with an isolated breakdown of the rotor, whether accidental or not. When this happens a thin layer of friable (abradable) material is irreversibly removed from the working surface; this leads to an irreversible increase in the clearances and thus to an equally irreversible reduction in the turbomachine's performance.

Apart from the problems caused by loss of aerodynamic performance, the misalignment of the rotor axis relative to the stator causes the release of abradable particles in the primary flow path, which can cause engine damage (in particular by causing ventilation holes in the turbine to be blocked).

Moreover, in the event of a large accidental misalignment, the rotor casing must be able to ensure that high energy moving parts do not escape. The structure of the casing is thus designed for this ultimate event.

U.S. Pat. No. 6,406,256 B1 discloses a rotating seal between the rotor and stator of an axial turbomachine. Specifically this interpretation addresses the problem of compensating for the variation in clearance between the blade tips and an outer shell in operating conditions covering a wide temperature range, such as is typically found in the turbine section of a turbomachine. The sealing device comprises a segmented outer shell arranged around the tips of the rotor blades. Each segment is held in the stator housing wall via fingers angled in the opposite direction to, and acting with, corresponding grooves in the housing wall. In the event of the temperature of the different segments increasing, the latter will expand and lengthen slightly. This lengthening will have the effect of moving the fingers away from their initial rest positions. Because they are angled, these fingers will move radially away from the rotor, which will effectively pull the segments up, thus compensating for the closing up of the segment blade tips resulting from the increase in temperature. This compensation device is interesting but lacks, however, compensation for variations in clearance caused by phenomena other than temperature variation. Indeed, the clearance between a row of rotor blades and the outer shell may also vary depending on their speed of rotation and also as a function of any misalignment due to maneuvering loads (gyroscopic torques related to variations in the attitude of the turbomachine), and the ingestion of foreign bodies (such as birds). A misalignment between the rotor and stator will modify the physical clearance between the blade tips and the shell so that the latter will come into contact with the shell on a particular sector and the clearance will increase considerably on the opposite sector.

US patent 2008/0159850 A1 discloses a rotating seal between the rotor and stator of the turbine section of an axial turbomachine. This interpretation addresses the problem of high shell temperatures and the need to cool the shell. The proposed solution consists essentially of a quick-fastening device, facilitating assembly and dismantling of the shell. More specifically, it consists of providing a segmented shell in which each segment is provided with a dovetail cross-section circumferential rib pointing radially towards the outside of the stator. This rib works in combination with a grooved section corresponding approximately in the stator housing wall. Optionally, a spring may be located in the housing wall to exert a force on the segments, this force acting substantially radially towards the centre of rotation of the rotor. This spring is intended to apply a contact force between the surfaces of the groove and the corresponding surfaces of the dovetail section rib so as to ensure a certain degree of tightness. Seals may also be arranged laterally on the rib, between the segmented surface which is opposite to the inner surface of the shell and the inner surface of the housing wall. These seals are made of solid material because of the high temperatures at which a turbine works. The advantage of this solution is that the different constituent segments of the shell can be easily replaced by a simple translational movement relative to the housing wall. Contrary to what FIG. 3 in the patent might suggest, the constituent segments of the shell are not capable of moving radially and, even less, compensating for any misalignment or variation in clearance whatsoever.

Patent FR 2636373 A1 relates to the problem of differential thermal expansions in a gas turbine and, more specifically, to compensating for the variation in clearance between the tips of the rotor blades and the associated shell. The proposed solution consists of a single closed ring-shaped jacket mounted on a rotor casing via a series of compensators using pneumatic bellows. Compressed air is fed to the compensators to exert radial forces on the shell and thereby control the radial clearance between the blade tips and the shell. This solution, although technically interesting and potentially powerful, limits itself to compensating evenly for the clearance over the entire circumference. It is therefore not capable of compensating for variations in clearance in the event of misalignment between the rotor and stator. In addition, it requires a means of controlling the air pressure, which makes its implementation relatively expensive and prone to failure.

SUMMARY

The invention aims to provide a seal between the rotor and stator of an axial turbomachine, overcoming at least one of the problems mentioned above. More particularly, the invention aims to provide a seal between the rotor and stator of an axial turbomachine compatible with misalignment between the rotor and stator. More particularly, the invention aims to propose a solution to the problems mentioned above for an axial turbomachine compressor.

The invention relates to a housing for covering the blade tips of a rotor row of an axial turbomachine compressor, comprising: a structural wall; a segmented shell intended to enclose the row of blades and supported by the wall; wherein it further comprises elastic means arranged between the wall and the segments of the shell so as to enable the segments to move radially in the event of contact with the tips of the rotor blades, in particular in the event of misalignment of the axis of rotation of the rotor relative to the axis of the housing.

According to an advantageous embodiment of the invention, the elastic means support the segments. The latter are held exclusively by the elastic means.

Optionally, the radial movement of the segments towards the tips may be limited by means of mechanical retention.

According to another advantageous embodiment of the invention, the elastic means comprises one or more elements made of one or more elastically deformable materials, the elasticity of the said elements being mainly based on the elasticity of the material or materials, the material or materials preferably being elastomeric.

According to yet another advantageous embodiment of the invention, the elastic means comprises a plurality of elastic elements distributed circumferentially and/or axially.

According to yet another advantageous embodiment of the invention, the elastic elements are spaced apart from each other so that they can deform freely.

According to yet another advantageous embodiment of the invention, the elastic means comprise a plurality of elastic elements each having a first end attached to the wall and a second end attached to a shell segment.

According to yet another advantageous embodiment of the invention, the first and/or second ends are attached by adhesion, preferentially by diffusion and/or by gluing.

According to yet another advantageous embodiment of the invention, the wall has an inner recess in which the elastic means are at least partially housed.

According to yet another advantageous embodiment of the invention, the shell segments each have ends that are beveled in a circumferential direction of the shell.

The jointed ends of the segments are preferably linked with one another and beveled in such a way that a radial movement of a segment towards the casing causes through the end linkages a similar movement in the adjacent segment in the direction of rotation of the rotor.

According to yet another advantageous embodiment of the invention, the ends of the segments have a cross-section generally inclined at between 30° straight.

According to yet another advantageous embodiment of the invention, the ends of each shell segment are tilted in the same direction circumferentially.

According to yet another advantageous embodiment of the invention, the shell segments have an inner surface which is frictionally compatible with the tips of the blades.

According to yet another advantageous embodiment of the invention, the inner surface of the shell segments have a friable coating in the event of their being rubbed by the blade tips.

The invention also relates to an axial turbomachine compressor, comprising: a rotor provided with at least one row of blades; a stator with a housing containing the rotor; notable in that the housing is constructed according to the invention.

According to an advantageous embodiment of the invention, mechanical clearance is provided between the tips of the blades and the shell when in normal operation when the axis of rotation of the rotor is aligned with the rotor axis.

Unlike prior art devices discussed above, the invention has the advantage of allowing radial displacement between the segments and thus compensation for misalignment between the rotor and stator, especially in the event of aircraft attitude changes or because of the ingestion of a foreign body. Identified prior art focuses on thermal problems in turbines and does not address in any way the problem of misalignment. This latter can appear suddenly and then disappear, such as during a change of attitude. The proposed solution, by segmentation of the body and the maintenance of these segments by elastic enables the shell to conform to a misalignment and then to revert to its initial circular shape.

The use of blocks of elastomeric materials has the advantage of the inherent high damping coefficients of elastomers.

Further areas of applicability of the present teachings will become apparent from the description provided herein. It should be understood that the description and specific examples are intended for purposes of illustration only and are not intended to limit the scope of the present teachings.

DRAWINGS

Corresponding reference numerals indicate corresponding parts throughout the several views of drawings.

DETAILED DESCRIPTION

In the following description, the terms "internal" and "external" are used to describe the surfaces of the shell and the housing wall relative to the envelope formed between the sleeve and the housing wall; "internal" then means inside that envelope, and "external" means outside that envelope.

In contrast, note that the term "external" to the shell (and not to its surface) is related to the generally annular fluid stream; "outer shell" designates a shell just within the outer or outside boundary of the fluid stream and "inner shell" designates a shell just outside the inner or internal boundary of the fluid stream.

Figure 1:
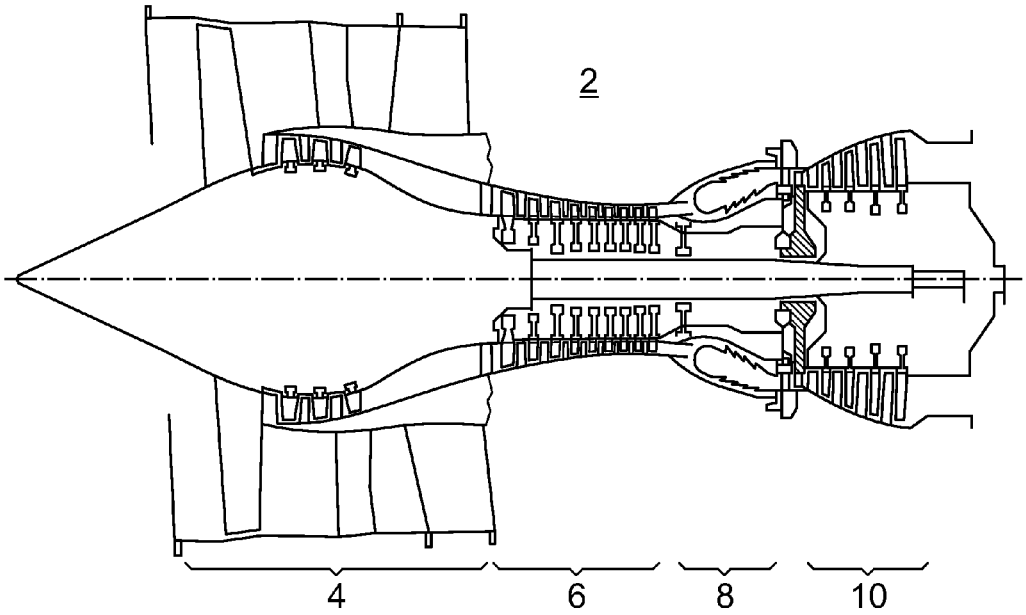
FIG. 1 is a schematic sectional view of a dual rotor axial flow turbofan, the type of aircraft engine whose low-pressure and/or high pressure compressor(s) are likely to be equipped with one or more of the sealing devices described in the invention.

The axial turbomachine 2 shown in FIG. 1 is a dual rotor aircraft jet engine. It includes, from upstream to downstream, a low-pressure compressor 4, a high pressure compressor 6, a combustion chamber 8 and a turbine 10. The low-pressure and high-pressure compressors 4 and 6 are not subject to the high temperatures to which the turbine 10 is subjected. It is therefore possible to use materials with a lower melting point for the manufacture of various components of the low-pressure and high compressors 4 and 6.

Figure 2:
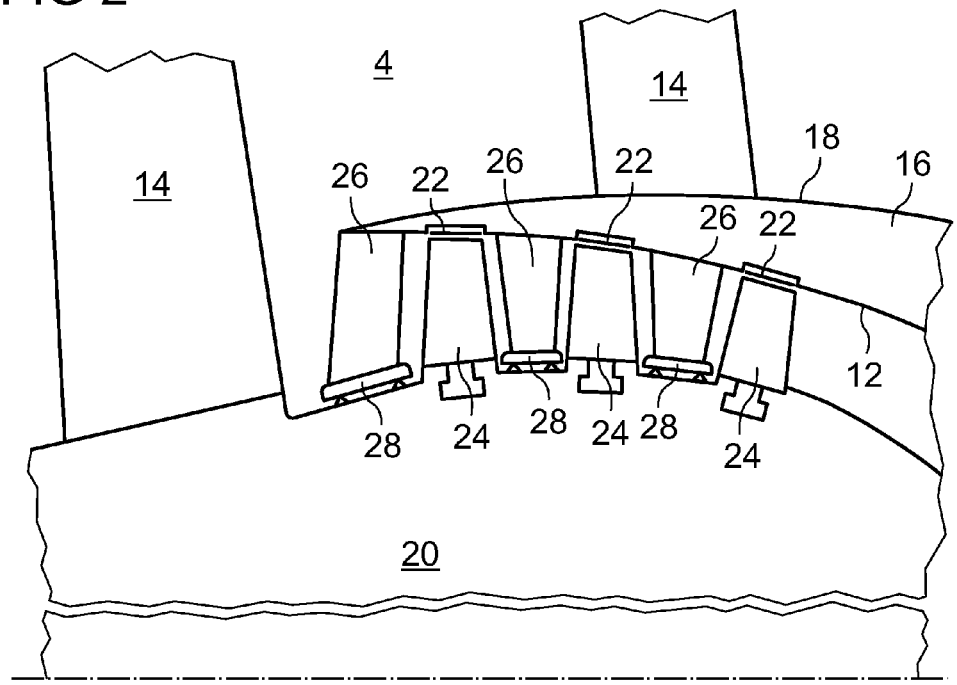
FIG. 2 is a partial sectional view of the low-pressure compressor of the engine of FIG. 1, the low-pressure compressor being fitted with the sealing devices described in the invention.

The low-pressure compressor 4 in FIG. 1 is shown in FIG. 2. Shown is the rotor 20 with several rows of so-called rotor blades 24. The stator consists of a housing 12 and a wall 16 marking the boundary of the secondary air flow. The housing 12 supports a series of fixed blades, so-called stators, 26. Each circumferential row of stator blades 26 forms, together with a circumferential row of rotor blades 24, a compression stage, the purpose of which is to increase the pressure of the fluid, in this case air, passing across it. As the pressure gradient is generally in an axial direction, it is necessary to provide a means of sealing between the rotating and fixed parts all the way along the fluid stream. An outer shell 22 fits over the outer tips of each row of rotor blades 24 with a certain amount of contact in order to ensure a seal.

Figure 3:
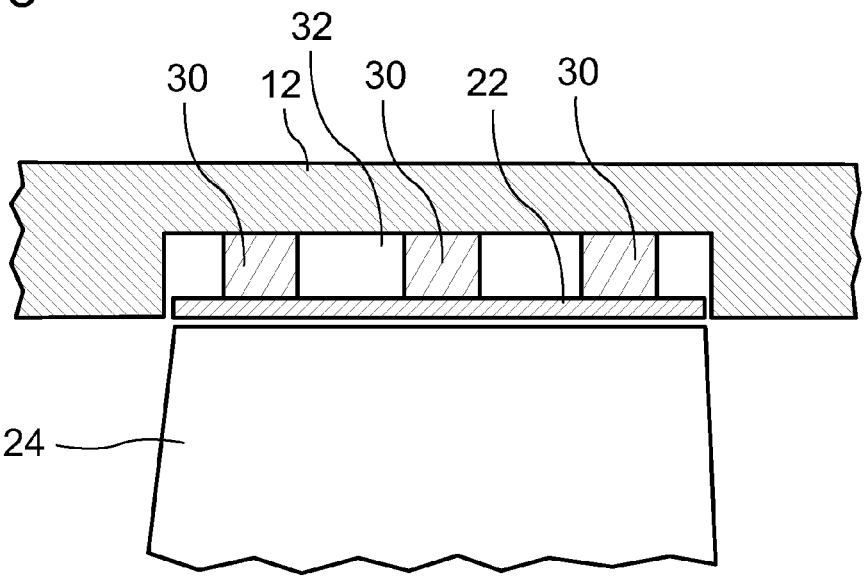
FIG. 3 is a sectional view of one of the sealing devices of the compressor in FIG. 2.

FIG. 3 is a sectional view of the housing 12 fitted with a sealing device as described in the invention. The housing wall 16 comprises a shaped recess 32 in the form of a channel cut into its internal face. This recess 32 contains a series of elastically deformable elements 30 fixed to its bottom surface and fixed to the shell 22. The shell 22 is partially located within the recess 32 and is located and fixed to the housing 12 by the elastically deformable elements 30 alone.

The shell 22 embodies a series of separate segments 22 so that it can move independently in case of misalignment between the rotor 20 and the stator. In fact, the elastically deformable elements 30 ensure an elastic connection between these different segments and the housing 12 so that in the event of contact with the inner surface of the shell 22 by the blade tips, the shell 22 segments subject to this contact can move into the recess 32 by deformation of the elastically deformable elements 30 under the force of the blade contact.

Figure 4:
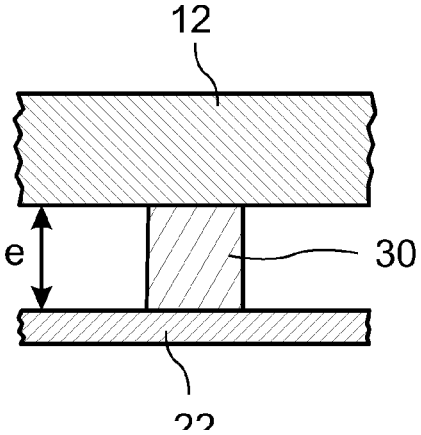
FIG. 4 is a detailed view of one of the elastic elements in FIG. 3, the elastic element making the connection between the shell and the housing.
Figure 5:
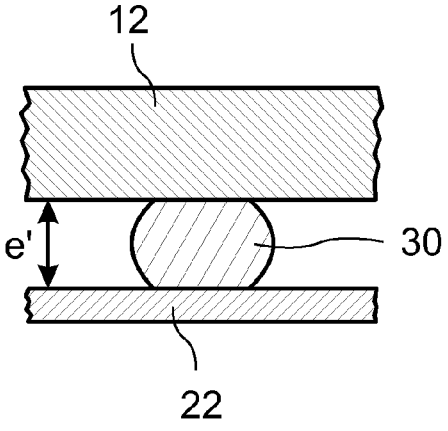
FIG. 5 is a view of the elastic element of FIG. 4 in a compressed state.

The effect of the deformation of the elements 30 is illustrated in FIGS. 4 and 5. In FIG. 4, one can observe an element 30 in its normal state where the outer surface of segment 22 of the shell 22 is at a distance e from the surface of the bottom of the recess 32 in the housing 12. This distance e is the height of the element 30. In FIG. 5, the same element 30 is in a deformed state under the effect of a force generated by the blade tips in contact with the inner surface of the segment 22 of the shell 22. Element 30 has a barrel shape with a height e', which is less than e, corresponding to the new distance between the outer surface of segment 22 of the shell 22 and the inner surface of the recess 32 in the housing 12.

The elastically deformable elements 30 are preferably made of elastomeric material. They are preferably glued to the housing 12 and the shell 22 respectively. They can also be linked by diffusion, by screws or other connecting method known to a person skilled in the art. The elastically deformable elements 30 are preferably made of an inherently elastically deformable material which endows them with their elastic deformability.

The elastically deformable elements 30 can also be mechanically deformable elements whose elastic deformability is based on a combination of an elastically deformable material and a particular geometry, such as, for example, springs.

As can be seen in FIG. 3, the shell segments 22 are preferentially linked to the housing 12 through several elastically deformable elements 30 arranged axially.

Figure 6:
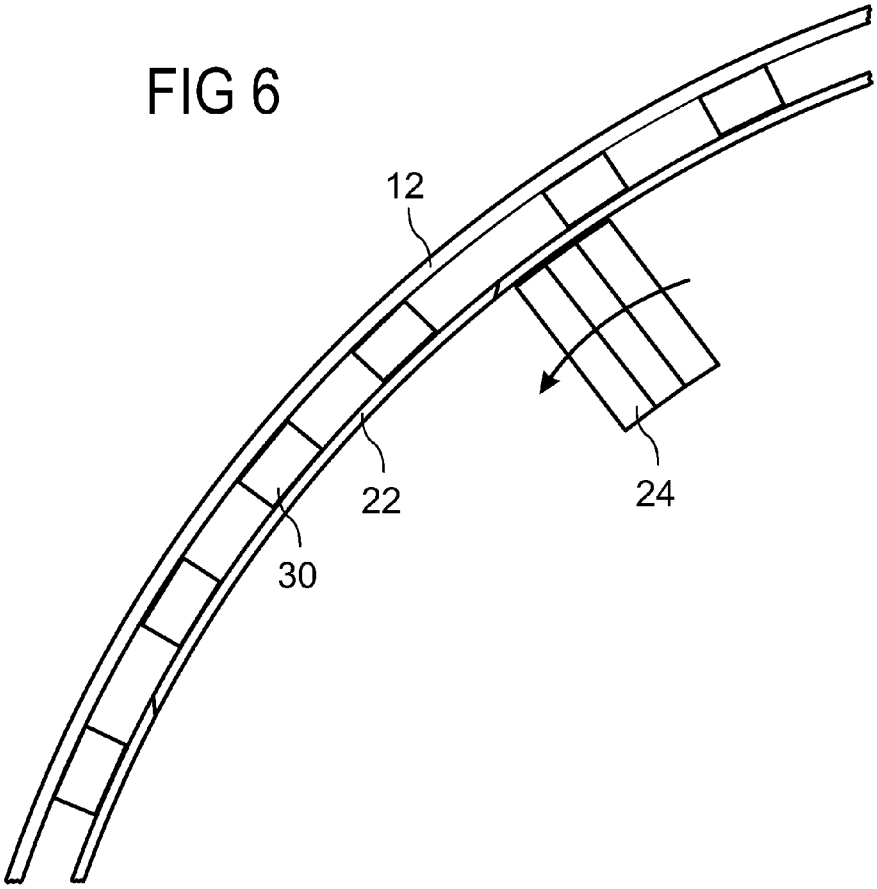
FIG. 6 is a sectional view of one the compressor sectors in FIG. 2, illustrating the sealing device of the invention.

FIG. 6 is a sectional view of a portion of the compressor housing 12 of FIG. 2. It can be seen that the shell 22 is segmented into a series of separate sections or segments which are separate from each other. The two circumferential ends of each segment 22 are beveled in the same direction so as to ensure continuity at the junctions between the different segments. It should be noted that the bevels are oriented relative to the direction of rotation of the rotor 20 so as to avoid projections at the junctions likely to come into positive contact with the moving blades 24. As can be seen in FIG. 6, the bevels are angled such that any outward radial movement of any segment draws with it the subsequent segment in the direction of rotation of the rotor 20. The beveled face on the trailing edge of the previous segment pushes out the beveled face on the leading edge of the subsequent segment. The inner surface of the shell 22 at the junctions thus remains essentially continuous. The shell 22, while having a circular shape at rest can deform to match any misalignment between the rotor 20 and stator.

The beveled ends of the segments are preferably generally planar. However, they can take various shapes to ensure that adjacent segments can interlock, as described above, ensuring continuity of the inner surface of the shell 22 at the junctions between the segments when the rotation of the rotor 20 puts pressure on certain segments. The ends can, for example, have a staircase-shaped profile in a plane perpendicular to the axis of rotation of the machine.

The elastically deformable elements 30 are placed on an ad hoc basis and distanced several circumferential rows from each other. Spacing the elements 30 one from another both axially and/or circumferentially allows individual elements 30 to deform freely and independently. Such an arrangement means, consequently, that there is no sealing between a point in the fluid stream passing through the compressor which is upstream of the blade row and another point in the fluid stream that is downstream. A minimum clearance between the upstream and downstream edges, respectively, of the shell segments 22 and the corresponding edges of the recess 32 (see FIG. 3) is provided to ensure an acceptable seal.

Figure 7:
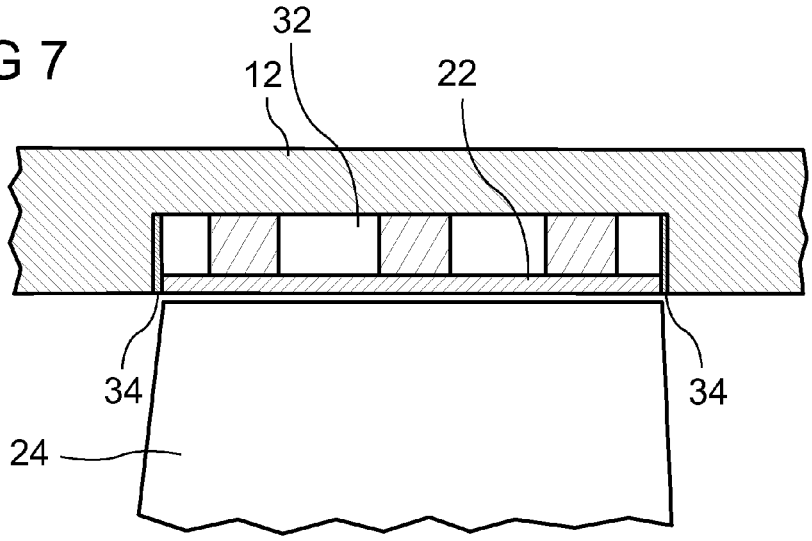
FIG. 7 is a sectional view of an alternative sealing device to the one shown in FIG. 3.

However, it is possible to provide a means of sealing between the upstream and downstream edges of the shell segments 22 and the corresponding recess 32 in the housing 12. Indeed, as illustrated in FIG. 7, a seal 34 is secured, for example, by gluing it to the edges of the recess 32, corresponding to the upstream and downstream edges of the shell 22. As well as providing sealing, the seals can also serve to damp out the movement of different segments of the shell 22.

In general, it should be noted that the shell 22 may have on its inner surface a coating of friable material capable of disintegrating when in frictional contact with the rotor blades 24. Such coatings are called "abradable" and are well known to those skilled in the art. The shell's ability to move and deform to match a misalignment between the rotor 20 and stator may mean that a much thinner and/or harder coating, or even no coating at all, is all that is needed. Indeed, it is conceivable that a smooth metal shell material free from any type of abradable coating could be used, given the advantages of the sealing device 34. The use of harder materials means that no, or very few, particles are shed that are capable of damaging the engine in contacts between the "abradable" coating and the moving rotor tips.

In general, it should also be noted that the sealing device 34 which is the subject of this document is not required to provide a total seal, particularly given the presence of a physical clearance between the blade tips and the inner surface of the shell 22.

It is also noteworthy that there are many possible alternatives to the elements or solid blocks of elastic material 30. Indeed, there are many elastic means and devices with a greater or lesser damping coefficient.

What is claimed is:

1. A housing for covering the ends of a row of blades of a rotor of an axial turbomachine compressor, said housing comprising:

a structural wall;

a segmented shell structured and operable to enclose the row of blades and supported by the wall; and a plurality of deformable elements positioned between the wall and the segments of the shell so as to allow the segments to move in the event of contact with the tips of the blades of the rotor, in the event of misalignment of the axis of rotation of the rotor relative to the axis of the housing, wherein the deformable elements comprise:

an elastomeric material;

a first end attached to the wall; and a second end attached to a shell segment.

2. The housing in accordance with claim 1, wherein the deformable elements are further structured and operable to support the segments.

3. The housing in accordance with claim 2, wherein the deformable elements comprise one or more elements made of elastically deformable materials, the elasticity of the elements being based on the elasticity of the materials.

4. The housing in accordance with claim 3, wherein the deformable elements comprise a plurality of elastic members that are at least one of circumferentially and axially distributed along the wall.

5. The housing in accordance with claim 4, wherein the deformable elements are spaced apart from each other such that they can deform freely.

6. The housing in accordance with claim 4, wherein at least one of the first ends and the second ends are attached by adhesion.

7. The housing in accordance with claim 6, wherein the at least one of the first ends and the second ends are attached via diffusion.

8. The housing in accordance with claim 6, wherein the at least one of the first ends and the second ends are attached via gluing.

9. The housing in accordance with claim 6, wherein the wall comprises an inner recess in which the deformable elements are at least partially housed.

10. The housing in accordance with claim 1, wherein the segments of the shell each have ends beveled circumferentially with respect to the shell.

11. The housing according to claim 10, wherein the ends of the segments have a cross-section generally inclined at between 30° and 60° with respect to a tangent.

12. The housing according to claim 11, wherein the ends of each segment of the shell are inclined circumferentially in the same direction.

13. The housing according to claim 12, wherein the shell segments have an inner surface which is frictionally compatible with the ends of the blades.

14. The housing according to claim 13, wherein the inner surface of the shell segments have a friable coating in the event of their being rubbed by the blade tips.

15. An axial turbomachine compressor, said compressor comprising:

a rotor provided with at least one row of blades; and a stator with a housing containing the rotor, wherein the housing comprises:

a structural wall;

a segmented shell structured and operable to enclose the row of blades and supported by the wall; and a plurality of deformable elements positioned between the wall and the segments of the shell so as to allow the segments to move in the event of contact with the tips of the blades of the rotor, in the event of misalignment of the axis of rotation of the rotor relative to the axis of the housing, wherein the deformable elements comprise:

an elastomeric material;

a first end attached to the wall; and a second end attached to a shell segment.

16. The axial turbomachine compressor in accordance with claim 15, wherein mechanical clearance is provided between the ends of the blades and the shell in normal operation when the axis of rotation of the rotor is aligned with the axis of the rotor.

* * * * *